United States Patent [19]

Gosselin et al.

[11] Patent Number: 5,020,222

[45] Date of Patent: Jun. 4, 1991

[54] VARIABLE FORCE COMPOUND ACTION LEVERAGE TOOL

[75] Inventors: Robert G. Gosselin, Springfield; Edward M. Wallace, Longmeadow, both of Mass.

[73] Assignee: Fiskars Oy Ab, Helsinki, Finland

[21] Appl. No.: 12,890

[22] Filed: Feb. 10, 1987

[51] Int. Cl.[5] ..... B26B 13/28

[52] U.S. Cl. ..... 30/251; 30/252; 30/260; 30/341

[58] Field of Search ..... 30/237–239, 30/250, 251, 254, 257, 260, 341; 16/DIG. 18

[56] References Cited

U.S. PATENT DOCUMENTS

| | | | |
|---|---|---|---|
| 107,542 | 9/1870 | Richard | 30/250 |
| 2,384,822 | 9/1945 | Drmic | 30/250 |
| 3,232,355 | 2/1966 | Woolworth | 16/DIG. 18 |
| 3,273,238 | 9/1966 | Kuhbier | 30/250 X |
| 3,650,028 | 3/1972 | La Pointe | 30/238 |
| 4,341,016 | 7/1982 | Harrison et al. | 30/341 X |

*Primary Examiner*—Frank T. Yost
*Assistant Examiner*—Rinaldi Rada
*Attorney, Agent, or Firm*—Foley & Lardner

[57] ABSTRACT

Shears are provided with a cutting mechanism for obtaining maximum leverage at the point in the cutting stroke corresponding to the maximum resistance. The cutting mechanism comprises cooperating first and second shearing members and a lever arm. The lever arm is pivotally connected to the first shearing member and a sliding connection is effected between the second shearing member and the lever arm.

9 Claims, 5 Drawing Sheets

VARIABLE FORCE COMPOUND ACTION LEVERAGE TOOL

TECHNICAL FIELD

The present invention relates, generally, to variable force compound action leverage tools such as compound action passby lopper shears.

BACKGROUND OF THE INVENTION

Shearing heavy growths such as tree limbs on the order of two inches in diameter requires considerable force. Lopping shears for cutting such heavy growths typically comprise a pair of relatively long-handled levers, cooperating with opposed cutting members, such as a blade and anvil, a hook and blade or respective blades. Levering of the handles forces the cutting members together or, in the case of a passby lopper, past one another, to effect the severing action.

Lopping shears are often characterized by the use of extra long handles to provide increased leverage. Such handles must be sufficiently strong to withstand the forces involved in cutting heavy growths. However, solid handles, typically wooden, tend to be overly heavy and awkward. On the other hand, lighter tubular handles tend to lack the requisite strength, particularly at certain major stress points, or are prohibitively expensive. Thus, the length of handles tends to be limited by weight and cost factors.

In general, the use of compound leverage action mechanisms to increase leverage in tools is well known. Compound leverage action mechanisms have been employed, for example, in hook-and-blade-type pruning apparatus, in anviltype tools, and in shears. Examples of such pruning apparatus are described in U.S. Pat. Nos. 4,420,883 and 4,442,603 issued to E. Wallace, et al, on December 20, 1983 and April 17, 1984, respectively. Examples of compound action shears are described in U.S. Pat. Nos. 492,198, issued to C. Hamann on February 21, 1893, 2,384,822, issued September 18, 1945 to S. Drmic, 2,528,816, issued to H. Boyer on November 7, 1950, and 3,650,028, issued to G. LaPointe on March 21, 1972. Use of compound action leverage mechanisms in lopping shears is also known. An example is described in U.S. Pat. No. 3,372,478, issued to E. Wallace, et al, on March 12, 1968.

However, known compound action leverage mechanisms, when used in such lopping shears, and particularly passby lopping shears, tend to be disadvantageous in a number of respects. The action mechanisms tend to be relatively complicated, and render difficult adjustment of blade tension and removal of the blade for sharpening. Further, torques applied to the handles in such shears tend to be transmitted to the blades of the shears, causing the blades to twist with respect to each other, impeding the cutting function and tending to overload and damage the blade pivot.

SUMMARY OF THE INVENTION

The present invention provides a particularly advantageous compound action leverage mechanism, suitable for use in lopping shears, which overcomes the disadvantages of the prior art, and further, provides an improved light-weight handle construction for tools such as shears.

More specifically, in accordance with one aspect of the present invention, the present inventors have determined that the resistance to cutting presented by a generally round, fibrous growth, such as, for example, a tree limb, varies as a function of the penetration of the cutting members into the growth. The maximum resistance is encountered at a predetermined point in the cutting stroke through the maximum-sized growth for which the tool is designed. The action mechanism is designed to provide maximum leverage at the point in the cutting stroke corresponding to that maximum resistance.

The cutting mechanism preferably comprises cooperating first and second shearing members and a lever arm. Handle levers are fixed on the lever arm and the first shearing member. The respective shearing members are pivotally connected, and the lever arm is pivotally connected to the first shearing member.

A sliding connection is effected between the second shearing member and the lever arm. The respective pivot points and the point of interaction between the second shearing element and the lever arm come into alignment in a common plane at a point in the cutting cycle corresponding to the maximum resistance encountered during a cutting stroke through a growth of predetermined diameter.

In the preferred embodiment, the first and second shearing members comprise a hook and a blade, respectively, and maximum leverage is provided in the range of approximately 60 to 62 percent through the cutting stroke. Further, the pivotal connection between the lever arm and the first shearing member (i.e., the hook) is preferably substantially flush with the inner surface of the shearing member to avoid interference with the pivotal movement of the second shearing member (i.e., the blade).

In accordance with another aspect of the present invention, the shearing members are substantially isolated from torques applied to the handles through effecting the sliding connection, using a stud and slot mechanism which restricts relative movement of the stud only in the plane of the lever.

In accordance with another aspect of the present invention, the lopper employs handles comprising a radially compressible cylindrical tube, a resiliently deformable rigid tubular insert disposed in that tube to receive the tang of the associated shear member (or lever arm), and a resiliently deformable end cap disposed over the mating end of the tube and having an aperture therein for receipt of the tang. These components are dimensioned to receive the tang in a manner which creates a compression fit between the insert and the cap, compressing the cylindrical tube in that region. This is achieved, in the preferred embodiment, by employing an oversized tang with dimensions greater than the dimension of the inner diameter of the tubular insert. Thus, with the rigid tubular insert disposed interiorly of the cylindrical tube and the end cap exteriorly thereabout, the tang may be driven forcibly through the end cap and into interfering engagement with the insert, distending both the insert and the cap and compressing the tubular handle therebetween. The wedging and compressive forces created are sufficient to retain the handle on the tang permanently without the need for glue, rivets, or other extraneous fasteners.

BRIEF DESCRIPTION OF THE DRAWING

A preferred exemplary embodiment of the present invention will hereinafter be described in conjunction with the appended drawing, wherein like numerals denote like elements and.

DETAILED DESCRIPTION OF A PREFERRED EXEMPLAR EMBODIMENT OF THE PRESENT INVENTION

Figure 1:
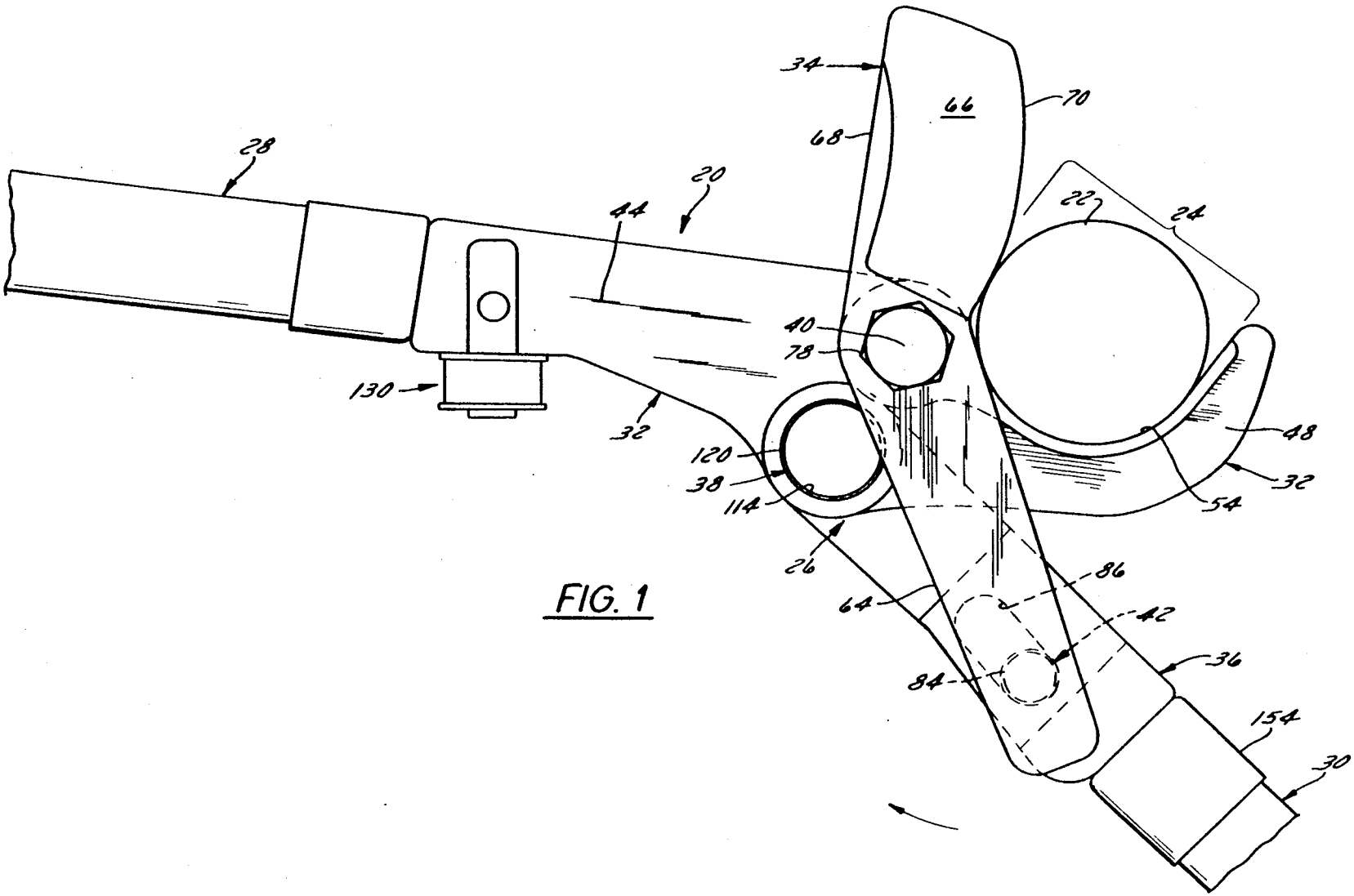
FIG. 1 is a side elevation view of a variable force shears in accordance with the present invention, showing a preferred embodiment thereof in a full open position receiving a generally cylindrical workpiece within a cutting zone at the beginning of a cutting stroke.

Referring now to FIGS. 1 through 4, variable force compound action lopping shears 20, in accordance with the present invention, comprises first and second shearing members 32 and 34, a lever 36, and respective handle levers 28 and 30. First and second shearing members 32 and 34 suitably comprise a hook 48 and blade 68.

Shearing members 32 and 34, and lever arm 36 cooperate as a compound lever action shearing mechanism, generally indicated as 26. Shear lever 36 is pivotally connected to first shearing member 32 at a fixed pivot 38 disposed in the vicinity of hook 48 and blade 68. Second shearing member 34 is joined to first shearing member 32 through a fixed pivot 40 and cooperates with lever 36 through a sliding connection 42 (sometimes hereinafter referred to, for ease of reference, as a dynamic or sliding pivot 42). In response to levering of handles 28 and 30, shearing members 32 and 34 articulate through a cutting stroke between a fully open position (FIG. 1), through a maximum leverage position (FIG. 2) to a fully closed position (FIG. 3). Shears 20 in the fully open position (FIG. 1) are designed to receive, in a cutting zone 24 between shearing members 32 and 34, a generally cylindrical workpiece, such as a tree limb or branch, of up to a predetermined maximum size (e.g., 2 inches), shown schematically as 22. As will be explained, shear members 32 and 34 and lever 36 are configured, and pivots 38 and 40 and dynamic pivot 42 are relatively disposed, so that such pivots come into alignment (FIG. 2) to provide maximum leverage at a predetermined point in the cutting cycle where maximum resistance to cutting is presented by a cylindrical growth of predetermined size (preferably the maximum size accommodated in full open position, e.g., 2 inches).

Figure 8:
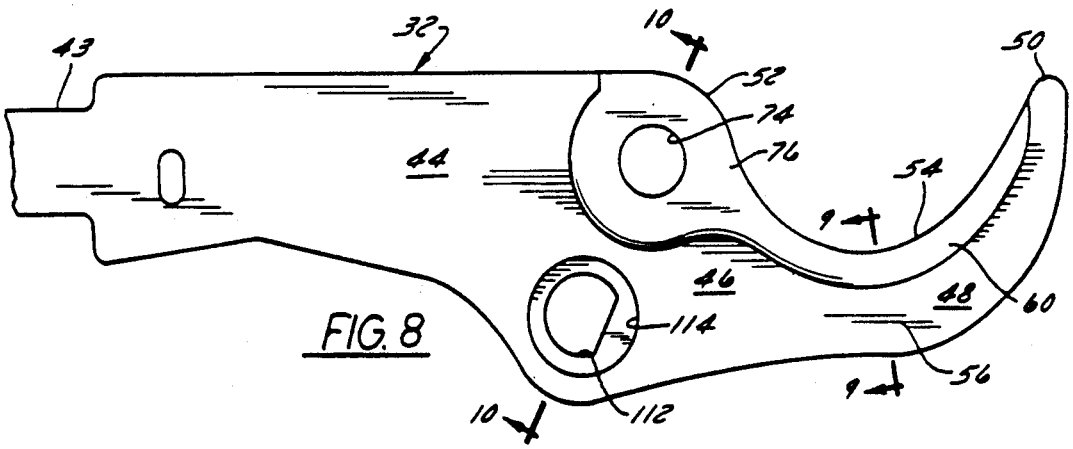
FIG. 8 is a plan view of the hook shearing member employed in the shears of FIG. 1.
Figure 9:
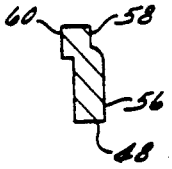
FIG. 9 is a sectional view of the hook of FIG. 8, taken substantially along the line 9—9.
Figure 10:
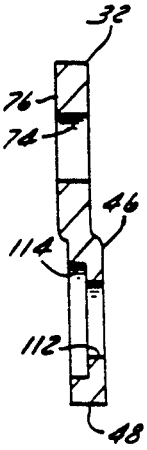
FIG. 10 is a sectional view of the hook of FIG. 8, taken substantially along the line 10—10.

Referring to FIGS. 8-10, first shearing member 32 suitably comprises a tang 43, a shank portion 44, a central region 46 and a hook portion 48. Hook 48 extends from a crown 52 to a tip 50, defining therebetween a jaw 54 for receiving the workpiece 22. Jaw 54 is curved in the vicinity of crown 52, having a radius of curvature chosen to accommodate a tree limb of the predetermined maximum size. From approximately the well of jaw 54 forward, towards tip 50, jaw 54 straightens to facilitate acceptance of the maximum size limb between the shearing members. The structure of the various elements of shears 20 are engineered to accommodate typical forces encountered in cutting such a limb.

As best viewed in FIG. 9, hook 48 is formed in a web of metal 56 having an offset lip 58. Lip 58 provides a face 60 over which second shearing member 34 passes during the cutting stroke. This configuration thus provides a sap groove to conduct that substance away during the cutting operation and minimizing binding of these cooperative or coacting elements.

Figure 2:
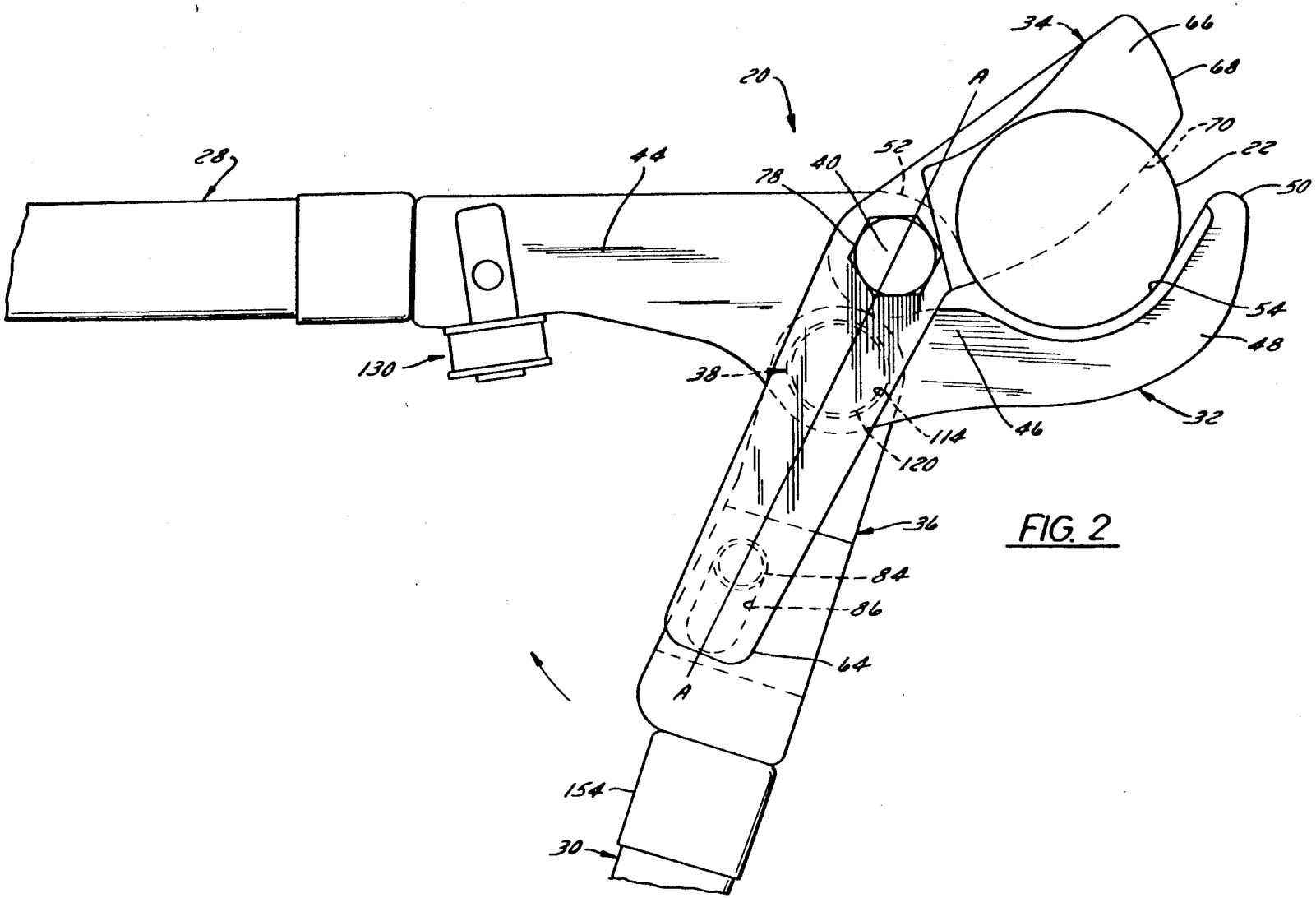
FIG. 2 is a view, similar to FIG. 1, but here showing the cutting stroke at a point corresponding to the maximum leverage.
Figure 3:
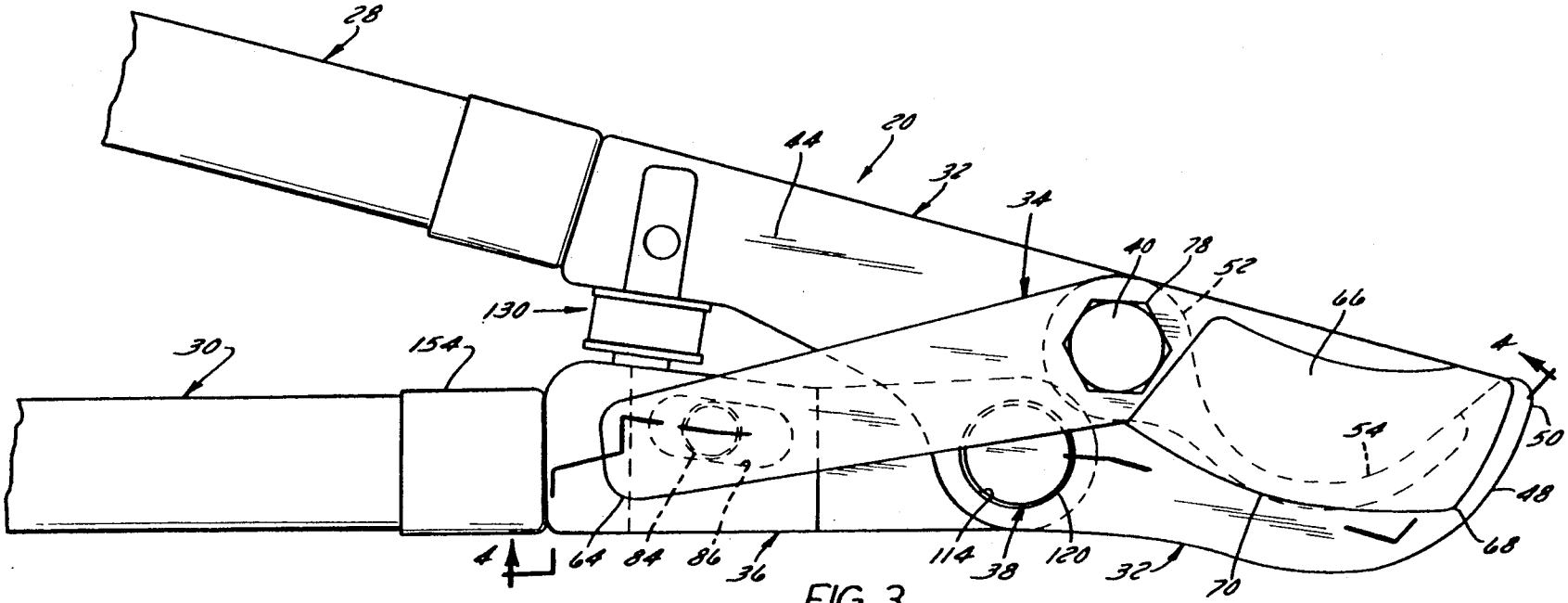
FIG. 3 is a view, similar to FIGS. 1 and 2, but here showing the shears following the severance of the workpiece at the conclusion of the cutting stroke.

Respective apertures 74 and 112 are provided in central region 46 of member 32, centered on a common straight line, generally indicated as A—A in FIG. 2, at the juncture of hook 48 and shank 44. Aperture 74 is surrounded by a raised boss 76, formed as an extension of, and coplanar with, face 60. Aperture 112 is suitably keyed, preferably in the shape of a "D" and counterbored, i.e., surrounded by a concentric recess 114. As will be explained, apertures 74 and 112 accommodate pivots 40 and 38, respectively.

Figure 11:
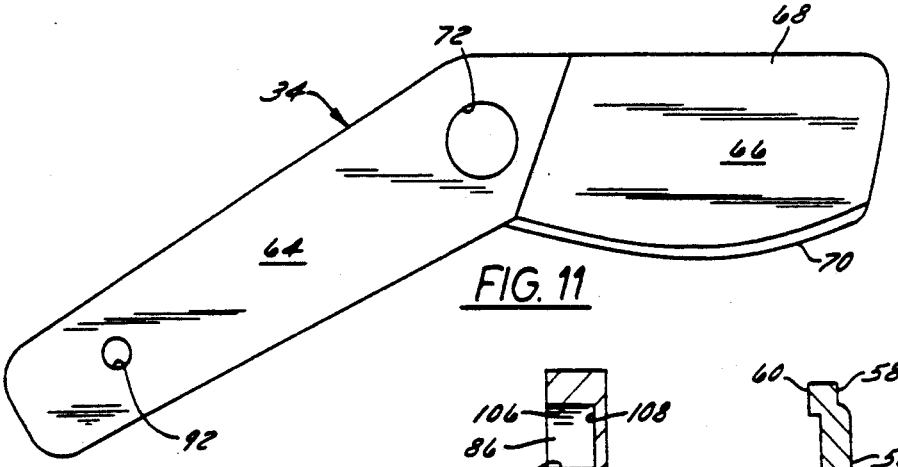
FIG. 11 is a plan view of the blade shearing member employed in the shears of FIG. 1.

Referring now to FIG. 11, second shearing member 34 suitably provides the active cutting edge for severing the workpiece 22, comprising a plate having a shank 64 and, at a generally obtuse angle, a blade 68. Blade 68 is formed, for example, by a grinding operation which yields a bevel of decreasing thickness culminating in an edge grind 70. The bevel 66 suitably reflects an included angle in the range of 9.5 to 10 degrees. Edge 70 of blade 68 is suitably curved, having a radius of curvature somewhat larger than that of jaw 54 of hook 48. Accordingly, the distal tip of blade 68 overpasses the tip of hook 48 prior to the point when the central portion of the blade overpasses the central portion of hook 48. Such an arrangement mitigates against the workpiece being extruded from between the shearing members. For a two-inch maximum size limb, the radius of curvature of blade edge 70 is suitably on the order of 3.25 inches. Respective apertures 72 and 92 are formed at the juncture of blade 68 and shank 64, and at the end of shank 64 respectively. As will be explained, apertures 72 and 92 facilitate pivot 40 and dynamic pivot 42, respectively.

Figure 5:
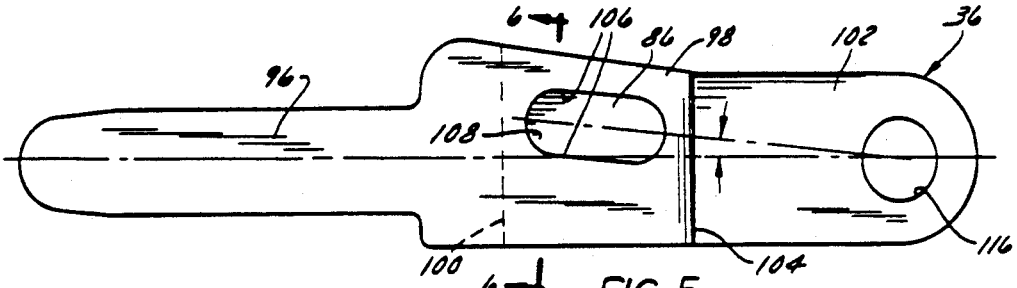
FIG. 5 is a plan view of the lever arm of the shears of FIG. 1.
Figure 7:
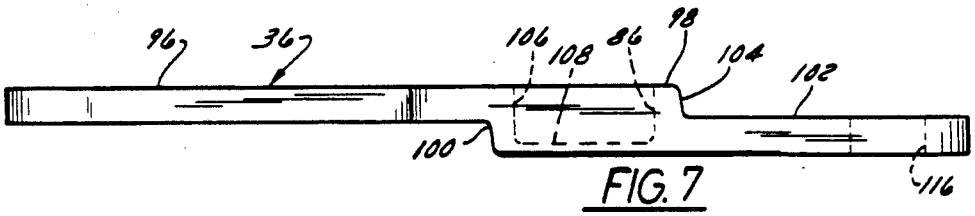
FIG. 7 is a side elevation view of the lever of FIG. 5.
Figure 6:
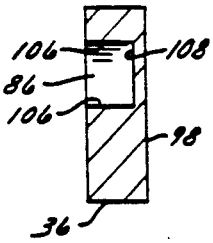
FIG. 6 is a sectional view, taken substantially along the line 6—6 of FIG. 5, showing a blind pocket in the lever.

Referring now to FIGS. 5-7, lever 36 suitably comprises a stepped plate having a tang 96 at its proximal end spreading laterally at and toward a thickened central region 98 at a first step 100 and thence merging at the distal end to a thinner plate section 102 at a step 104. The extent of step 104 is suitably approximately equal to the thickness of first shearing member 32 in the vicinity of aperture 112. A slot 86 is formed in thickened central region 98, preferably, a blind pocket or recess defined by interior side walls 106 (FIG. 6) and a bottom wall 108, and respective radiused ends. In the illustrated embodiment, the central region 98 is approximately twice the thickness of either end. This advantageously accommodates a deep blind pocket. As will be explained, slot 86 facilitates the dynamic pivot relationship between lever 36 and second shearing member 34. An aperture 116 is formed at the distal end of section 102 of lever 36. Aperture 116 facilitates the pivotal connection of lever 36 to first shearing member 32 at pivot 38.

Figure 4:
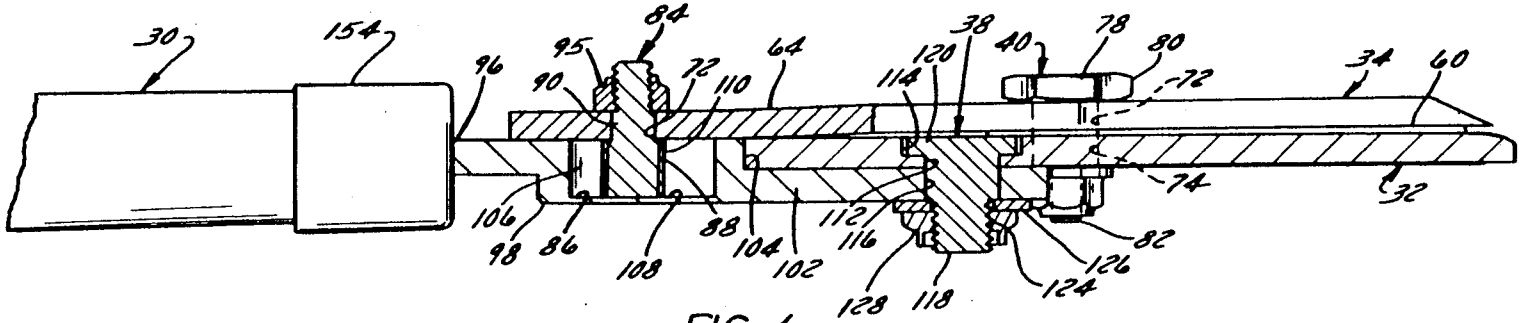
FIG. 4 is a sectional view, taken substantially along the line 4—4 of FIG. 3, illustrating the cooperative interrelationship of the components comprising the shears of FIG. 1.

In assembly, lever 36 is pivotally attached to first shearing member 32 at fixed pivot 38. Referring now to FIGS. 4, 5 and 8, lever 36 is disposed, in assembly, with section 102 underlying central portion 46 of first shearing member 32, with aperture 116 in registry with aperture 112. A bolt 118 (FIG. 4) is disposed through apertures 112 and 116. Bolt 118 includes a head 120 having a thickness approximately equal to the depth of circular recess 114 and a D-shaped shank for keyed disposition through the D-shaped aperture 112 and thence through the round-shaped aperture 116. The shank is stepped to a reduced threaded region 124 which receives a washer 126 and lock nut 128 to secure the bolt.

Shearing members 32 and 34 are pivotally connected at fixed pivot 40 (FIGS. 1 and 4). Referring now to FIGS. 4, 8 and 11, aperture 72 is dimensioned and positioned in assembly, to register with aperture 74 in the central region 46 of first shearing member 32. Boss 76, surrounding aperture 74 and coplanar with face 60, functions as a bearing surface or rider for the blade. A bolt 78 (FIG. 4), having a head 80 and threaded shank 82, is disposed through apertures 72 and 74 and secured with a washer and lock nut 83. Preferably, the threaded region of bolt 78 is confined to the portion of shank 82 projecting beyond aperture 74, leaving a smooth shank for contact within the apertures 72 and 74, providing an unencumbered or smooth pivot for the blade.

Second shearing member 34 is slidably coupled to lever 36. Referring now to FIGS. 4, 5, 7 and 8, shearing member 34 articulates from dynamic pivot 42 at the proximal end of the shank 64. Dynamic pivot 42 is provided by a stud 84 which projects from the underside of shank 64 and is received within slot 86 in lever 36. In the preferred embodiment, stud 84 comprises a base section 88 of a diameter slightly smaller than the width of slot 86 stepped to a smaller diameter tenon at 90, approximately commensurate with aperture 72. Tenon 90 is disposed through aperture 72 in shank 64. A cylindrical bearing sleeve 110 is suitably disposed about base 88 of stud 84. The portion of tenon 90 projecting beyond shank 64 is suitably threaded, and cooperates with a lock nut 95 to capture stud 84 as an integral component of second shearing member 34. Nut 95, and the details of stud 84 are omitted from FIGS. 1–3 for ease of illustration.

When second shearing member 34 is coupled to first shearing member 32 at fixed pivot 40, stud 84 projects into slot 86. Preferably, the diameter of bearing sleeve 110 is approximately equal to the width and radiused ends of slot 86. Accordingly, the two cooperate closely without play or lost motion. Further, in assembly, the face of shank 64 overlying slot 86 completely closes slot 86 from the top. Since slot 86 is thus closed, it can, therefore, be packed with and retain grease or a similar lubricant to reduce wear. The grease packing is easily replenished when the blade is removed for sharpening.

Movement of the articulated linkage comprising the compound lever action mechanism 26 in response to levering of handles 28 and 30 creates a cutting stroke of blade 68 relative to hook 48. As handles 28 and 30 are urged together from the position of FIG. 1 toward the position of FIG. 3, lever 36 pivots about pivot 38 relative to first shearing member 32. As lever 36 moves, slot 86 moves along an arcuate path toward the opposed first shearing member. The movement of slot 86 is coupled to shank 64 of second shearing member 34 through interaction of slot sidewalls 106 with stud 84. Accordingly, blade 68 commences rotation about fixed pivot point 40 to initiate the cutting stroke, during which edge 70 begins to sever the workpiece 22.

The present inventors have determined that the resistance to cutting presented by a generally round, fibrous workpiece, such as, for example, a tree limb, varies as a function of the penetration of the cutting member into the growth. More specifically, three primary factors tend to control variation through the cutting stroke of the cutting resistance of the generally round tree limb: (1) the extent of the blade actually engaging the limb varies as the blade proceeds through the limb; (2) the fibers underlying the cutting area tend to compress as the cutting progresses, increasing the density of the workpiece and the resistance to cutting; and (3) friction and the wedging effect of the increasing thickness of the blade along the bevel from the edge increase as the blade proceeds through the workpiece. Thus, as the blade proceeds through a cutting stroke, resistance to cutting is initially small, increasing to a maximum resistance typically encountered at a point somewhat beyond the midpoint of the limb, then subsides until the cutting operation is complete. For the hook and blade configuration of the preferred embodiment, it has been found that the maximum resistance occurs at approximately 62 percent of the cutting stroke. For other typical blade-and-hook configurations suitable for use with heavy growths, the maximum resistance tends to be encountered in the range of from 60 to 62 percent of the cutting stroke. In general, blade, blade-and-anvil, and blade-and-hook configurations typically excounter maximum resistance of a point within the range of from approximately 55 to 65 percent of the cutting stroke.

Compound action lever mechanism 26 is designed to deliver maximum cutting force at the point where maximum cutting resistance is encountered in a cutting stroke through the maximum size limb accommodated by the shears. Maximum leverage and hence maximum force, is provided when pivots 38, 40 and 42 come into alignment in a common plane perpendicular to the cutting plane. Accordingly, pivots 38, 40 and 42 are configured and disposed to come into alignment along a straight line, shown as line A—A of FIG. 2, at a point in the cutting cycle corresponding to the predetermined point of maximum resistance (e.g., 62 percent through the cutting cycle). Where pivots 40 and 42 lie outwardly of pivot 38 as in FIG. 1 and where they lie inwardly of pivot 38 as in FIG. 3, lesser force is transmitted to the cutting zone 24. However, less cutting force is required at the beginning and termination of a cutting stroke through the limb.

Pivots 38 and 40 are relatively disposed so that pivot 38 is effectively centered on the straight line running between the centers of pivot 40 (aperture 72) and stud 84 (aperture 92), when blade 70 is in a position corresponding to the predetermined point of maximum resistance.

Slot 86 is disposed to accommodate and position stud 84 in each of the full open, maximum force, and full closed positions. Accordingly, slide 86 is suitably centered upon line A—A, i.e., along the line defined by the centers of pivots 38 and 40 and extending a sufficient length along that line to accommodate stud 84 in the maximum force position (FIG. 2) and in a desired full open position (FIG. 1). The position of the distal end of slot 86 suitably corresponds to the position of stud 84 in the maximum force position. Thus, a larger area of engagement between stud 84 and slot 86 is provided; engagement is provided not only through tangent contact of stud 84 with sidewall 106 (FIG. 5) of slot 86, but also with a portion of the radiused end of the slot. The position of the proximate end of slot 86 suitably corresponds to the position of stud 84 with shear 20 in the desired full open position. The proximate end of slot 86 thus cooperates with stud 84 to serve the additional purpose of providing a full open limit stop without requiring additional elements.

When the cutting operation concludes, shearing members 32 and 34 overlie as shown in FIG. 3. Desirably, a shock-damping means identified generally as 130 is provided to act as a step and to absorb a portion of the impulse which occurs at the termination of the cutting stroke.

It should be appreciated that compound action mechanism 26 is advantageous in a number of respects. As noted above, maximum force is provided at a point in the cutting stroke through a maximum size limb corresponding to maximum resistance. Further, second shearing member 34 is fixed in the mechanism solely by bolt 78 and washer and nut 83; the interaction of stud 84 and slot 86 restrains only movement in the cutting plane. Thus, second shearing member 34 can be readily removed for sharpening or replacement and tensioning or adjustment of blade 68 relative to hook 48 can be effected independently of handle interaction. Further typical components of forces on handles 28 and 30 perpendicular to the cutting plane (i.e., torques on the handles) are not transmitted from lever 36 to member 34; dynamic pivot 42 does not restrict relative movement between member 34 and lever 36 in the direction perpendicular to the cutting plane and thus effectively isolates blade 68 from such forces.

Figure 13:
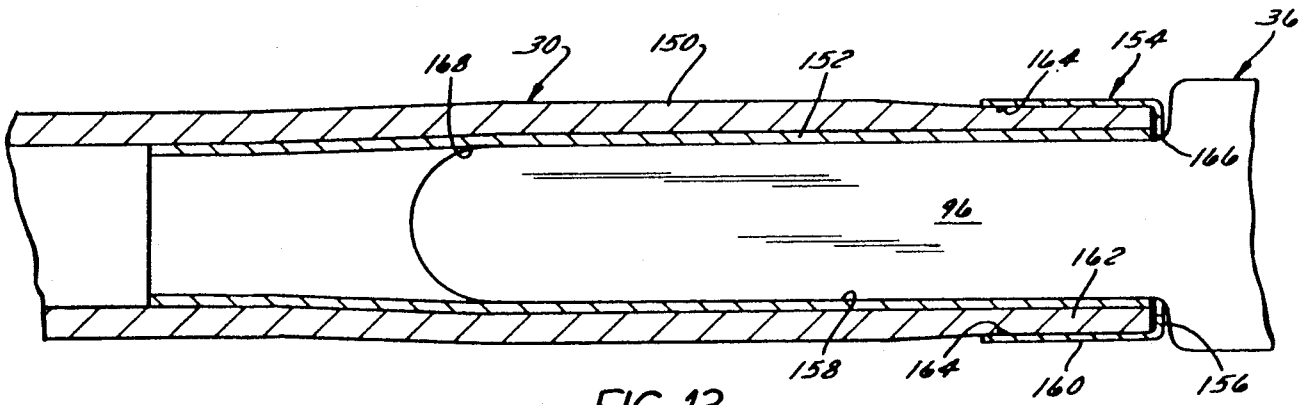
FIG. 13 is a sectional view, taken substantially along the line 13—13 of FIG. 12; and, FIG. 14 is an end elevation view of the end cap of the handle assembly of FIG. 12, looking into the cap from its open end.
Figure 12:
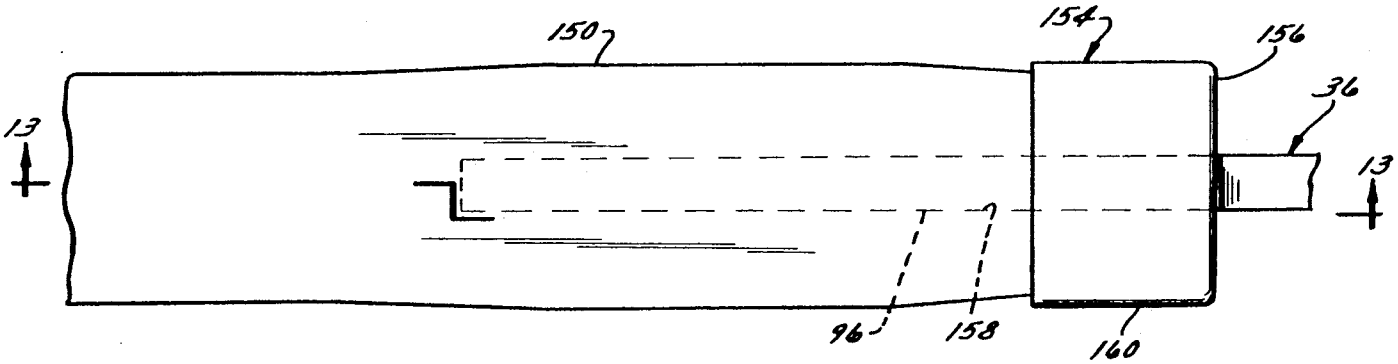
FIG. 12 is a fragmentary, side elevation view of a handle in accordance with one aspect of the present invention, showing the tang of the shears in phantom disposed interiorly of the tubular member.
Figure 14:
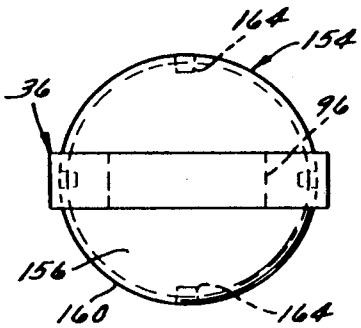

In accordance with another aspect of the present invention, shear 20 employs a particularly advantageous light-weight, non-conductive handle construction. Handles 28 and 30 receive the tangs of first shearing member 32 and lever member 36. Referring now to FIGS. 12–14, handle 30 will be described as exemplary.

Handle 30 suitably comprises a radially compressible cylindrical tube 150, and a resiliently deformable rigid tubular insert 152 and end cap 154. In the preferred embodiment, tube 150 is a hollow fiberglass tube. Such a fiberglass tube is relatively light in weight, non-conductive and strong. However, fiberglass has historically been found deficient as a handle material as it tends to fray, break and otherwise fail at points of stress concentration. Nonetheless, the assembly for the handle 30 maximizes the advantages of fiberglass, light weight and environmental integrity, but without the normal structural limitations associated with a fiberglass construction. This is achieved by the cooperative association of hollow tube 150, resilient insert 152, end cap 154 and a controlled profile for the tang 96.

Tubular insert 152 is disposed interiorly of the tube 150 at the end disposed to receive tang 96. End cap 154 is disposed over the extreme distal end of tube 150. End cap 154, best viewed in FIG. 14, includes a generally circular face 156 including a rectangular aperture 158 to receive tang 96. A skirt 160 depends from face 156 to extend down tube 150 and create a zone 162 in which the handle is sandwiched between insert 152 and skirt 160. A plurality of inwardly projecting detents 164 are preferably formed in the end cap 154, along skirt 160, to help hold the end cap to the fiberglass tube. Detents 164 are easily formed during the fabrication of the end cap simply by shearing a slight amount of metal up from the wall of skirt 160, pushing it rearwardly until a raised projection or the like is yielded.

Tubular insert 152 has an outer diameter approximately equal to the inner diameter of hollow tube 150. Likewise, the inner diameter of the end cap 154 is approximately equal to the outer diameter of tube 150. Accordingly, these components are freely assembled and may be maintained together by the resulting frictional forces. However, at least the inner diameter of tubular insert 152 is undersized relative to the width dimension of tang 96 over the zone of cooperative interengagement (i.e., at least the portion of the tang extending from the juncture with the shank region of lever 36 lengthwise beyond the projection of skirt 160). Consequently, as tang 96 is driven through the aperture 158 and into and within the interior of insert 152, these resiliently deformable components are distended, bowing into an ovate or generally elliptical geometry and sandwiching the zone 162 of the tubular handle under considerable compressive force. To facilitate assembly, the tang 96 is preferably somewhat tapered to permit its insertion through the aperture 158 and into the insert 152 before encountering an initial snug fit. Thereafter, the tang is driven into engagement to distend the resilient components and create the restraining force necessary to associate the handle with the tool. It has been found that the preferred materials for the tubular insert 152 and end cap 154 to obtain the best balance of fatigue characteristics and holding force is a steel having a Rockwell B hardness of about 60 to 90.

The two points of greatest stress concentration during use of the tool will be found at fulcrum junctures of the tang with the handle elements. Thus, forces contributing to shear are maximum at the juncture 166 where the tang first enters the handle assembly and at the juncture 168 where the tapered tang deviates from contact with the interior of insert 152. As is evident from FIG. 13, however, the fiberglass tubular handle 150 is fully protected at both of those junctures. Forces arising during manipulation of the tool are distributed adequately along the handle by the tubular insert 152 and, by virtue of the reasonably uniform force distribution, the handle is highly serviceable. Thus, the advantages of light weight but good structural integrity necessary for handles of this sort are both provided while the assembly itself is simply achieved without the need for glue or other fixturing members.

While the invention has now been described with reference to certain preferred embodiments, those skilled in the art will appreciate that various substitutions, changes, modifications and omissions may be made without departing from the spirit thereof. Accordingly, it is intended that the scope of the present invention not be limited by such a description but be fully coextensive with the broadest interpretation allowable for the appended claims.

We claim:

1. Shears for effecting a cutting stroke through a workpiece wherein a maximum resistance to cutting is anticipated at a predetermined point in the cutting stroke, said shears comprising:

first and second shearing members;

a first pivot connection between said shearing members; and means for articulating said shearing members through said cutting stroke, said means for articulating comprising:

a lever;

a second pivot connection between said lever and said first shearing member; and connecting means for effecting a point of interaction between said lever and said second shearing member, wherein:

said second shearing member overlies said first shearing member in the vicinity of said first pivot connection and said first shearing member overlies said lever in the vicinity of said second pivot connection;

said second pivot connection does not extend substantially further than said first shearing member in the vicinity of said second pivot connection, towards the plane of said second shearing member; and said first and second pivots and said point of interaction are disposed to come into alignment, to thus provide maximum force in said cutting stroke, at said predetermined point in said cutting stroke.

2. Shears for effecting a cutting stroke through a workpiece wherein a maximum resistance to cutting is anticipated at a predetermined point in the cutting stroke, said shears comprising:

a first shearing member including first and second apertures;

a second shearing member including a third aperture, said second shearing member at least in part overlying said first shearing member with said third aperture in general registry with said first aperture;

a first pivot connection disposed between said shearing members, comprising a first fastener having a shaft extending through said first and third apertures; and means for articulating said shearing members through said cutting stroke, said means for articulating comprising:

a lever including a fourth aperture and a generally linear slot;

a second pivot connection between said lever and said first shearing member; and connecting means, comprising a projection extending from said lever slot, for effecting a point of interaction between said lever and said second shearing member;

said first shearing member at least in part overlying said lever with said second aperture in general registry with said fourth aperture;

said second pivot connection comprising a second fastener having a shaft extending through said second and fourth apertures; and said first and second pivots and said point of interaction being disposed to come into alignment, to thus provide maximum force in said cutting stroke, at said predetermined point in said cutting stroke.

3. The shears of claim 2, wherein said second aperture is counterbored and said second fastener includes a head received within the counterbore.

4. The shears of claim 2, wherein said lever slot is a blind pocket.

5. The shears of claim 4, wherein one end of said lever slot is disposed corresponding to the position of said projection when said shearing members are in a desired full open position, such that said slot and projection cooperate as a full open stop.

6. The shears of claim 2, wherein one end of said lever slot is disposed corresponding to the position of said projection when said shearing members are in a desired full open position, such that said slot and projection cooperate as a full open stop.

7. The shears of claim 2, wherein said first shearing member comprises a hook shank portion and a hook portion, said first aperture being disposed in the vicinity of the juncture between said hook shank and hook portions; and said second shearing member comprises a blade shank portion and a blade portion, said third aperture being disposed in the vicinity of the juncture of said blade shank and blade portions, and said projection being disposed on said blade shank.

8. Shears for effecting a cutting stroke through a workpiece wherein maximum resistance to cutting is anticipated at a predetermined point in the cutting stroke, comprising:

first and second shearing members disposed to form a cutting zone proximate the distal ends of and between said shearing members during said cutting stroke;

a first fixed pivot connection between said shearing members;

means for articulating said shearing members between fully open and fully closed positions, comprising:

a lever having a distal end pivotally secured to said first shearing member intermediate the length thereof outwardly proximate said cutting zone;

second fixed pivot connection securing said lever to said first shearing member; and a translatable pivot connection between said lever and said second shearing member, said second shearing member being pivotally secured to said first shearing member at said fixed pivot intermediate the length of each of said shearing members outwardly proximate said cutting zone and being secured to said lever at said translate pivot proximate the proximal end of said second shearing member and intermediate the length of said lever remote from said cutting zone; wherein said pivots are disposed to come into an aligned position coincident with the anticipated point of maximum workpiece resistance during said cutting stroke;

said first shearing member and said lever each include a shank terminating in a tang, said shears further comprising handle means, receiving said tangs, for manipulation of said shears between said open and closed positions; and said handle means comprise a radially compressible cylindrical tube having a length greater than the length of said tang, a resiliently deformable, rigid tubular insert disposed in said tube to receive said tang, and a resiliently deformable cap disposed over the distal end of said tube; and further wherein said tang is received in and creates a compression fit between said insert and said cap.

9. The shears of claim 8, wherein said tang is tapered having a width dimension along its intermediate course within the projected region of said cap along said tang greater than the inner diameter of said tubular insert and the corresponding height dimension of said aperture.

* * * * *